US008123821B2

(12) United States Patent
Gilmurray

(10) Patent No.: US 8,123,821 B2
(45) Date of Patent: Feb. 28, 2012

(54) REGULATING VANADIUM INHIBITOR IN A GAS TURBINE

(75) Inventor: Paul Gilmurray, Bangkok (TH)

(73) Assignee: General Electric Company, Schenectady, NY (US)

( * ) Notice: Subject to any disclaimer, the term of this patent is extended or adjusted under 35 U.S.C. 154(b) by 366 days.

(21) Appl. No.: 12/368,381

(22) Filed: Feb. 10, 2009

(65) Prior Publication Data

US 2010/0199546 A1 Aug. 12, 2010

(51) Int. Cl.

| | |
|---|---|
| ***C10L 1/10*** | (2006.01) |
| ***F02G 3/00*** | (2006.01) |
| ***F02C 3/20*** | (2006.01) |
| ***F02C 7/00*** | (2006.01) |

(52) U.S. Cl. ..... 44/300; 60/39.281; 60/39.461; 60/39.55

(58) Field of Classification Search ..... 44/300; 60/39.281, 39.46, 39.55

See application file for complete search history.

(56) References Cited

U.S. PATENT DOCUMENTS 5,819,540 A * 10/1998 Massarani ..... 60/732

FOREIGN PATENT DOCUMENTS

WO WO8908803 * 9/1989

* cited by examiner

*Primary Examiner* — Cephia D Toomer

(74) *Attorney, Agent, or Firm* — Hoffman Warnick LLC; Ernest B. Cusick

(57) ABSTRACT

A method and system are disclosed that enable an automatic regulation of a vanadium inhibitor in a fuel of a gas turbine. In one embodiment, the method includes obtaining an indication as to whether an additional inhibitor is required in the fuel of the gas turbine based on an amount of vanadium and an inhibitor in the fuel of the gas turbine, in response to the indication that the additional inhibitor is required, having an inhibitor control system automatically instructing an injector to inject the additional inhibitor into the fuel of the gas turbine to inhibit the vanadium.

9 Claims, 2 Drawing Sheets

REGULATING VANADIUM INHIBITOR IN A GAS TURBINE

BACKGROUND OF THE INVENTION

The subject matter disclosed herein relates generally to gas turbines and more specifically to regulating the injection of vanadium inhibitor in the fuel of a gas turbine.

BRIEF DESCRIPTION OF THE INVENTION

A method and system are disclosed that enable an automatic regulation of a vanadium inhibitor in a fuel of a gas turbine. In one embodiment, the method includes obtaining an indication as to whether an additional inhibitor is required in the fuel of the gas turbine based on an amount of vanadium and an inhibitor in the fuel of the gas turbine, in response to the indication that the additional inhibitor is required, having an inhibitor control system automatically instructing an injector to inject the additional inhibitor into the fuel of the gas turbine to inhibit the vanadium.

A first aspect of the invention provides a method comprising: obtaining an indication as to whether an additional inhibitor is required in a fuel of a gas turbine based on an amount of vanadium and an inhibitor in the fuel of the gas turbine, in response to the indication that the additional inhibitor is required, having an inhibitor control system automatically instructing an injector to inject the additional inhibitor into the fuel of the gas turbine to inhibit the vanadium.

A second aspect of the invention provides a system comprising: a gas turbine control system comprising an inhibitor control system including: a data analyzer that obtains an amount of vanadium and an inhibitor in a fuel of a gas turbine, a comparator for comparing the amounts of the vanadium and the inhibitor to a recommended amount for the gas turbine, a determinator for determining an amount of an additional inhibitor that is required in the fuel of the gas turbine and an injector that injects the additional inhibitor into the fuel of the gas turbine to inhibit the vanadium.

BRIEF DESCRIPTION OF THE DRAWINGS

These and other features of this invention will be more readily understood from the following detailed description of the various aspects of the invention taken in conjunction with the accompanying drawings that depict various aspects of the invention, in which.

It is noted that the drawings are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
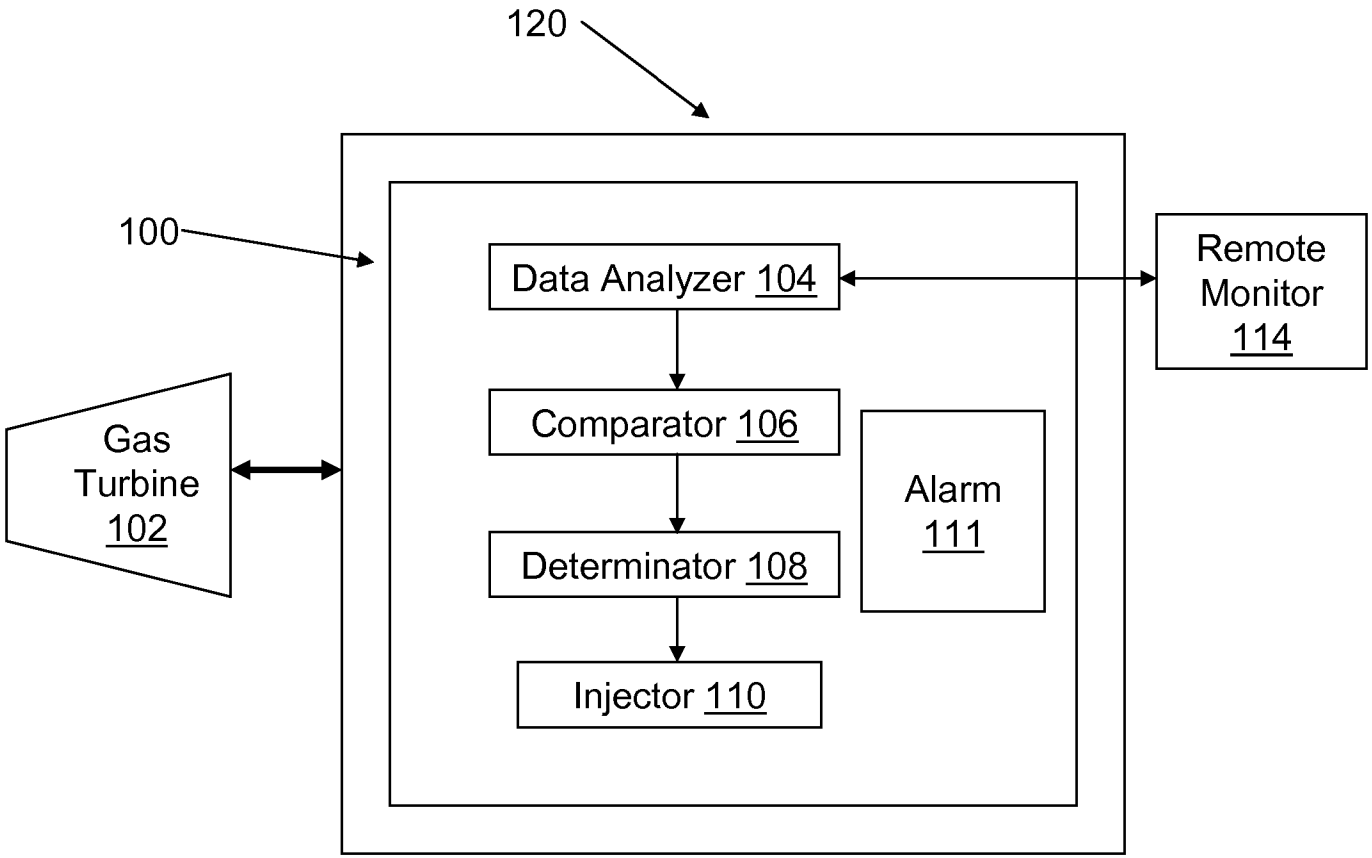
FIG. 1 shows a block diagram of an illustrative environment for implementing embodiments of a system according to the invention.

As indicated above, aspects of the invention provide a method and system for automatically regulating a vanadium inhibitor in the fuel of a gas turbine. The methodology includes obtaining an indication as to whether an additional inhibitor is required in a fuel of a gas turbine based on an amount of vanadium and an inhibitor in the fuel of the gas turbine, and in response to the indication that the additionally inhibitor is required, having an inhibitor control system automatically instructing an injector to inject the additional inhibitor into the fuel of the gas turbine to inhibit the vanadium.

In one embodiment, the methodology discussed herein provides for a gas turbine control system 120 that comprises an inhibitor control system 100 that includes a data analyzer 104, a comparator 106, a determinator 108, an injector 110 and an alarm 111. Inhibitor control system 100 automates the process of monitoring the amounts of inhibitor and vanadium in the fuel of gas turbine 102 and also the injection of additional inhibitor into the fuel of gas turbine 102 if it is determined additional inhibitor is required. Inhibitor control system 100 reduces the need for operator oversight of the amounts of the vanadium and the inhibitor in the fuel of gas turbine 102 and the injection of the additional inhibitor. Additionally, inhibitor control system 100 allows for the continual injection of the additional inhibitor based on the reported amounts of the vanadium and the inhibitor contained in the fuel of gas turbine 102. Moreover, inhibitor control system 100 reduces the possibility of operator error by automatically injecting the additional inhibitor into the fuel of gas turbine 102.

Figure 2:
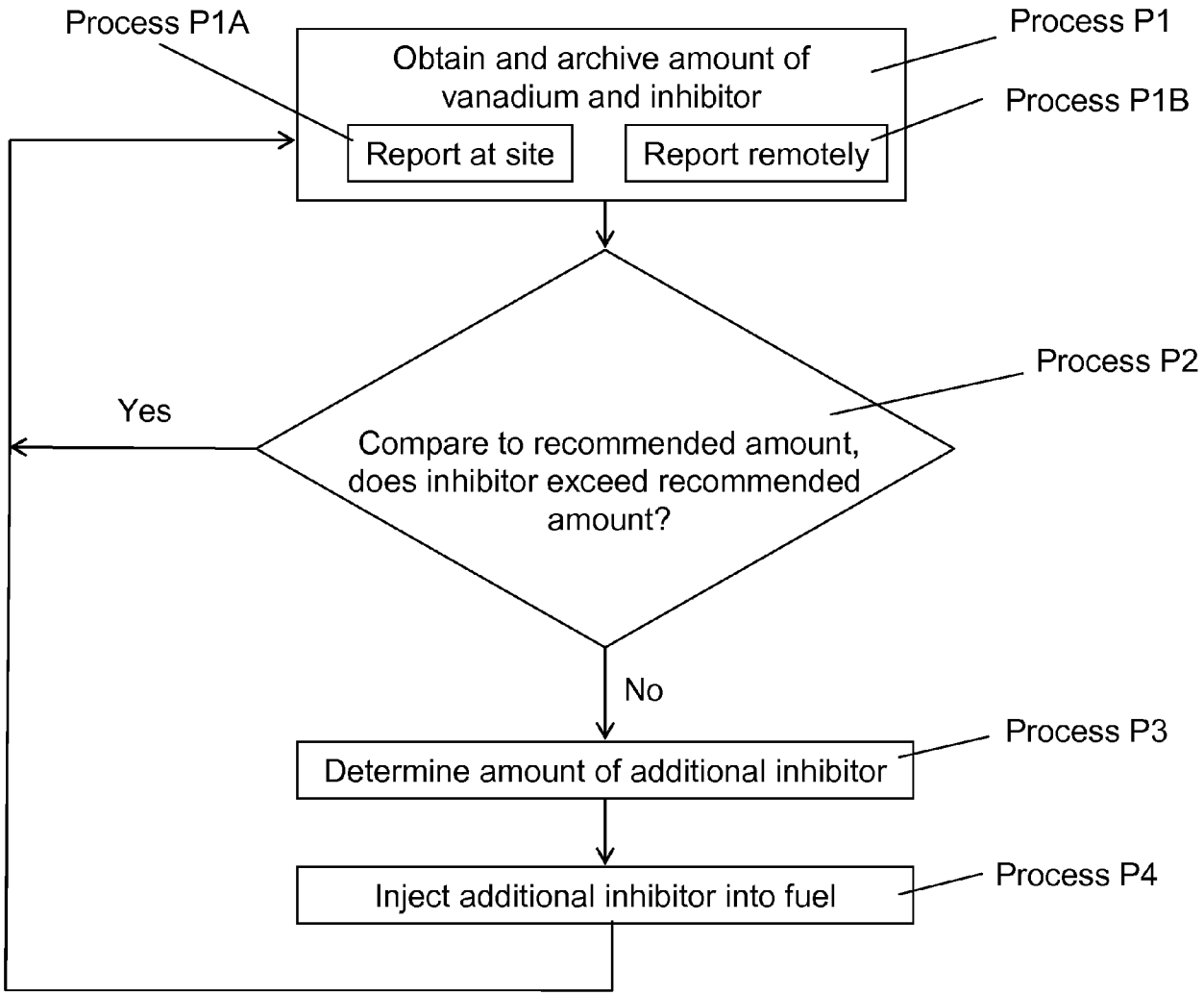
FIG. 2 shows a flow diagram of embodiments of a method of using the system of FIG. 1.

Turning to the drawing, FIG. 2 shows a flow diagram illustrating one embodiment of the process of inhibitor control system 100 is depicted. In process P1, data analyzer 104 obtains an amount of the vanadium and the inhibitor contained in the fuel of gas turbine 102. Data analyzer 104 may comprise a spectrometer or any other device capable of determining the amount of vanadium and inhibitor in the fuel of gas turbine 102. Data analyzer 104 may also archive the amounts of vanadium and inhibitor in the fuel of gas turbine 102. In another embodiment, the output of data analyzer 104 can be reported to remote monitor 114. Remote monitor 114 can also maintain an archive of the amounts of vanadium and inhibitor in the fuel of gas turbine 102. In one embodiment, in process P1A, data analyzer 104 may report at the same site as inhibitor control system 100. In another embodiment, in process P1B, data analyzer 104 may report remote monitor 114, which may be located at any location other than where inhibitor control system 100 is located.

After obtaining the amounts of the vanadium and the inhibitor from data analyzer 104, in process P2, comparator 106 compares the amounts of the vanadium and the inhibitor to the recommended amounts for gas turbine 102. If the amount of the inhibitor exceeds the recommended amount (YES at process P2), then data analyzer 104 repeats the obtaining an indication as to whether an additional inhibitor is required in the fuel of gas turbine 102 (process P1). If the amount of the inhibitor does not exceed the recommended amount (NO at process P2), then at process P3, determinator 108 determines the amount of additional inhibitor that may be injected into the fuel of gas turbine 102. Determinator 108 may include a processor that performs an algorithm to determine the amount of inhibitor required or may base the amount on a lookup or any other solution. In process P4, injector 110 injects the additional inhibitor into the fuel of gas turbine 102. After process P4, inhibitor control system 100 repeats process P1 and obtains the amount of vanadium and inhibitor in the fuel of gas turbine 102.

Returning to process P2, in one embodiment, comparator 106 may automatically compare the amount of the vanadium and the inhibitor in the fuel of gas turbine 102 with the recommended amounts. In an alternative embodiment, comparator 106 allows for an operator located at the site of gas turbine 102 to compare the amounts of the vanadium and the inhibitor contained in the fuel of gas turbine 102 with the recommended amounts. In another embodiment, in the event of a failure of inhibitor control system 100 or one of its components, the control of the inhibitor injection by injector 108 can be accomplished by manual control whereby an operator compares the amounts with the recommended amounts and manually adjusts the injection rate. The recommended amounts may be established by the gas turbine's manufacturer or the gas turbine's owner.

As noted above, if it has been determined by process P2 that the amount of the inhibitor, as compared with the amount of vanadium in the fuel of the gas turbine, does not exceed the recommended amount, then in process P3 determinator 108 determines the amount of additional inhibitor that injector 110, and in process P4, may inject into the fuel of gas turbine 102. In one embodiment, injector 110 automatically injects the additional inhibitor into the fuel of gas turbine 102. In an alternative embodiment, injector 110 allows for an operator located at the site of gas turbine 102 to manually inject the additional inhibitor into the fuel of gas turbine 102. Inhibitor may include a magnesium compound such as magnesium sulfonate, magnesium sulfate or magnesium oxide. In one embodiment, in process P4, injector 110 may inject the additional inhibitor into the fuel of gas turbine 102 at a ratio of approximately 3 parts inhibitor to 1 part vanadium. However, other ratios may be possible.

In an alternative embodiment, inhibitor control system 100 may also provide a notice from alarm 111 to an operator in the event of an incorrect amount of inhibitor to vanadium in the fuel of gas turbine 102 or if the amount of vanadium and inhibitor have not been updated in pre-determined period of time. Inhibitor control system 100 may also initiate a shutdown (gradual or immediate) of gas turbine 102 if there is an incorrect amount of inhibitor to vanadium. The magnitude of the error may be time-weighed as determined by inhibitor control system 100. For example, a large error for a short time may initiate an immediate gas turbine 102 shutdown, while a smaller error may initiate a gradual gas turbine 102 shutdown.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system comprising:

a gas turbine control system comprising an inhibitor control system, the inhibitor control system including:

a data analyzer that obtains an amount of vanadium and an inhibitor in a fuel of a gas turbine;

a comparator for comparing the amounts of the vanadium and the inhibitor to a recommended amount for the gas turbine;

a determinator for determining an amount of an additional inhibitor that is required in the fuel of the gas turbine; and an injector that injects the additional inhibitor into the fuel of the gas turbine to inhibit the vanadium.

2. The system of claim 1, wherein the additional inhibitor includes a magnesium compound.

3. The system of claim 2, wherein the additional inhibitor includes magnesium sulfonate, magnesium sulfate or magnesium oxide.

4. The system of claim 2, wherein the additional inhibitor is added at a ratio of approximately 3 parts inhibitor to 1 part vanadium.

5. The system of claim 1, wherein the amount of the additional inhibitor injected into the fuel of the gas turbine is based on a continual obtaining of the indication as to whether the additional inhibitor is required in the fuel of the gas turbine.

6. The system of claim 5, wherein the injector automatically injects the amount of the additional inhibitor injected into the fuel of the gas turbine.

7. The system of claim 1, wherein the inhibitor control system provides an alarm to an operator in the event of an incorrect amount of the inhibitor to the vanadium or the amount of the inhibitor and the vanadium have not been obtained for a predetermined period of time.

8. The system of claim 1, wherein the inhibitor control system performs a shutdown of the gas turbine in response to an incorrect amount of the inhibitor being present in the fuel of the gas turbine.

9. The system of claim 1, wherein the data analyzer reports the amount of the vanadium and the inhibitor in the fuel of the gas turbine to a remote monitor.

* * * * *